US005990830A

United States Patent [19]

Vail et al.

[11] Patent Number: 5,990,830

[45] Date of Patent: Nov. 23, 1999

[54] SERIAL PIPELINED PHASE WEIGHT GENERATOR FOR PHASED ARRAY ANTENNA HAVING SUBARRAY CONTROLLER DELAY EQUALIZATION

[75] Inventors: David K. Vail, Palm Bay; Mark D. Fisher, West Melbourne; Stephen S. Wilson, Melbourne, all of Fla.

[73] Assignee: Harris Corporation, Melbourne, Fla.

[21] Appl. No.: 09/138,417

[22] Filed: Aug. 24, 1998

[51] Int. Cl.[6] ..... H01Q 3/22

[52] U.S. Cl. ..... 342/368; 342/377

[58] Field of Search ..... 342/372, 377, 342/368

[56] References Cited

U.S. PATENT DOCUMENTS

| | | | |
|---|---|---|---|
| 4,217,587 | 8/1980 | Jacomini | 343/100 |
| 4,229,739 | 10/1980 | Smith | 343/100 SA |
| 4,814,774 | 3/1989 | Herczfeld | 342/372 |
| 4,931,803 | 6/1990 | Shimko | 342/371 |
| 5,027,126 | 6/1991 | Basehgi et al. | 342/372 |
| 5,084,708 | 1/1992 | Champeau et al. | 342/377 |
| 5,103,232 | 4/1992 | Chang et al. | 342/372 |
| 5,339,086 | 8/1994 | DeLuca et al. | 342/371 |
| 5,396,256 | 3/1995 | Chiba et al. | 342/372 |
| 5,493,307 | 2/1996 | Tsujimoto | 342/380 |

*Primary Examiner*—Mark Hellner
*Attorney, Agent, or Firm*—Charles E. Wands

[57] ABSTRACT

A "just in time" pipelined signal processing architecture for a phased array antenna simultaneously updates the weights of all phase control elements of the antenna with reduced wiring complexity and fast beam steering updates. Signal propagation paths between a pipelined communication link—through subarray control processors distributed along the pipeline link—and phase control elements of the antenna array are provided with respectively different serial pipelined transport delays. These delays are such that all phase control signals produced by the subarray control processors are applied simultaneously to their associated subsets of antenna phase control elements. The use of serial (FIFO) delays to equalize pipeline and weight processing latency allows each subarray controller to process and forward serial beam vector data at the same data rate at which it is received from an upstream host processor.

10 Claims, 2 Drawing Sheets

SERIAL PIPELINED PHASE WEIGHT GENERATOR FOR PHASED ARRAY ANTENNA HAVING SUBARRAY CONTROLLER DELAY EQUALIZATION

FIELD OF THE INVENTION

The present invention relates in general to communication systems and is particularly directed to a pipelined control processing architecture for a phased array antenna having minimal wiring complexity and fast beamsteering update rates. Signal propagation paths between a pipelined communication link through subarray control processors distributed along the pipeline link and phase control elements of the array are provided with respectively different transport pipelined delays, so that all phase control signals produced by the subarray control processors are applied simultaneously to their associated subsets of antenna phase control elements.

BACKGROUND OF THE INVENTION

Electronically steered phased array antennas are used extensively in a variety of terrestrial, airborne and spaceborne communication systems and networks. Because of the diversity of applications, the rate at which the composite beam produced by an electronically steered phased array antenna requires updating can vary from a very low update rate (e.g, on the order of only one or two Hz) to very rapid pointing angle update rates (e.g., on the order of hundreds of kHz or more). Where the array employs a relatively large number of (antenna and associated phase shift) elements (on the order of a thousand or more, as a non-limiting example), especially systems with high update rates that are controlled by a single 'broadcasting' array controller/processor, not only is there a substantial computational intensity burden placed on the controller, but the wiring configuration between the controller and the phase shift elements of the array can become very complex and costly.

One way to reduce such cost and hardware penalties associated with the use of a centralized array controller is to distribute the beam steering processing among a number of subarray controllers, each of which is responsible for computing phase weights for only a given portion or subset of the array. In order to compensate for the propagation delay through respective subarray controllers and the differential delays among signal paths between the controllers and the array elements driven thereby, it is customary practice to buffer the computational results of subarray processing in associated memory units, and then simultaneously read out the steering weight data stored in each memory unit for its associated subarray weight set. A principal drawback to the use of such auxiliary memories is the fact that not only do they constitute significant additional hardware, but limit the phased array's effective update rate, since, until the calculation results stored in the memory units are read out and cleared, each subarray controller is unable to receive and begin processing new or updated steering vector data.

SUMMARY OF THE INVENTION

In accordance with the present invention, both the computational intensity burden and wiring complexity of the centralized array controller approach, and the update rate limitations of conventional memory-based subarray controller approaches are effectively obviated by a "just in time" pipelined signal processing architecture. As will be described, the pipelined signal processing architecture of the invention contains a plurality of pipelined subarray controllers that are serially distributed along a serial data transmission link from an upstream control processor. An external host processor sends beamsteering commands to the control processor, which formats the commands for the serial distribution.

The head end or upstream control processor is coupled to receive digitally formatted antenna beam steering or pointing angle data from the host processor and executes the requisite trigonometric calculations through which the beam steering data is transformed into phase gradient data in the (X,Y) coordinate system of the phased array. Confining the trigonometric transform operations to this single processing unit at the source end of the pipeline considerably reduces the computational and hardware complexity of downstream components of the system.

Each subarray controller is preferably implemented as a pipelined multiplier and adder arrangement, and is operative to convert serial (X,Y) phase gradient data from the control processor into a subset of parallel multibit phase shift parameter data, that define contributions of a prescribed portion of the composite beam produced by the multi-element phased array antenna. These respective sets of phase element control data are applied over either serial or parallel multibit digital output links to associated subsets of phase shift elements, that drive associated antenna elements of a spatial subset of the multi-element antenna array.

Included with each subarray controller is a serially shifted, first-in, first-out (FIFO) implemented path delay, defined such that the phase control signals produced by each subarray control processor are applied simultaneously to its associated subset of antenna phase control elements. The use of serial FIFO delays to equalize serial pipeline distribution delay allows each subarray controller to process and forward, "just-in-time" without buffering, the serial beam vector data at the same data rate at which the phase gradient data is received from the upstream control processor.

DETAILED DESCRIPTION

Figure 1:
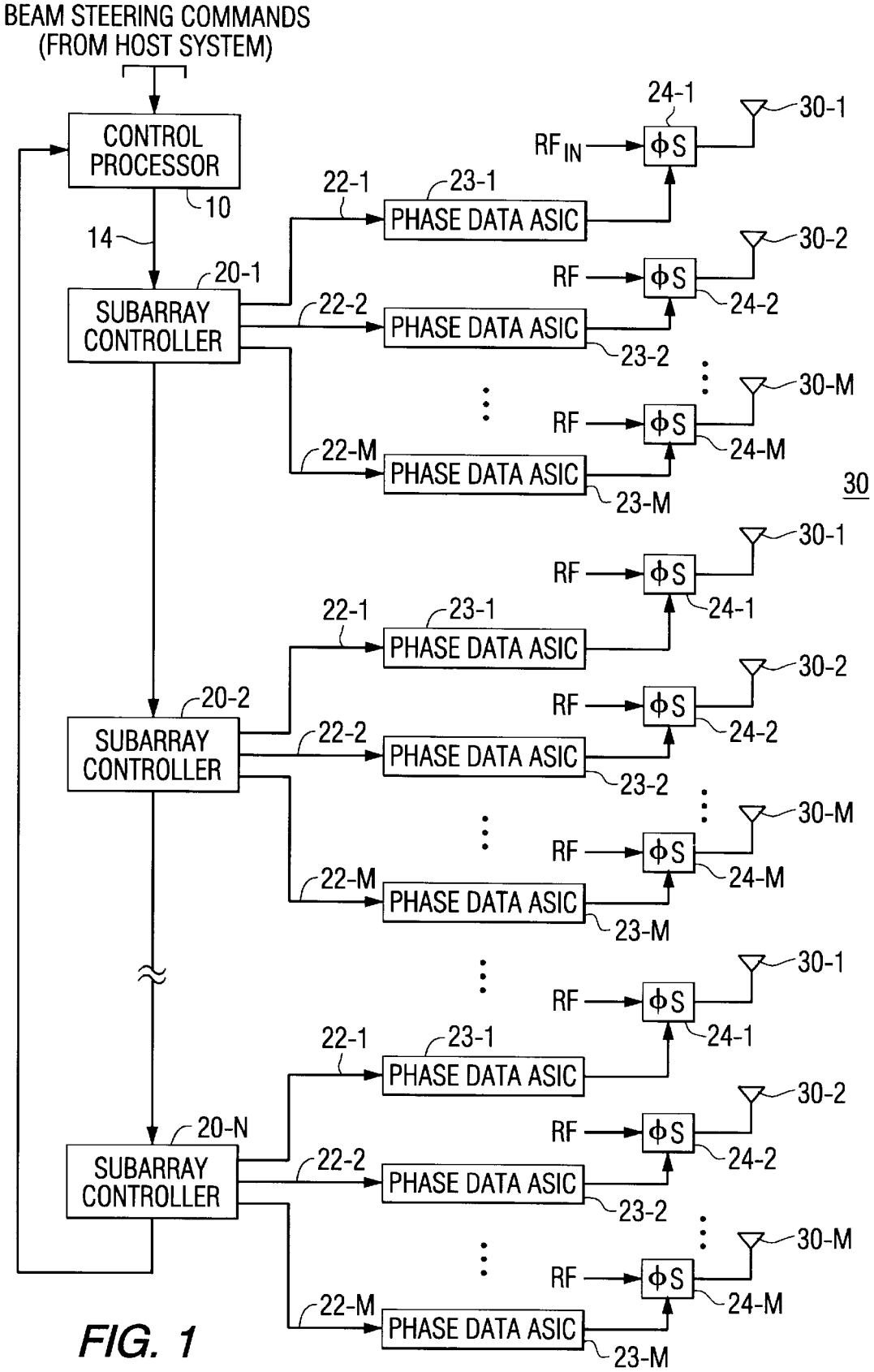
FIG. 1 diagrammatically illustrates a "just in time" pipelined signal processing architecture for a phased array antenna in accordance with the present invention.

Before describing in detail the serial pipelined signal processing architecture of the present invention, it should be observed that the invention resides primarily in what is effectively a prescribed arrangement of conventional communication devices and components and associated digital signal processing circuits therefor. As a non-limiting example, the various signal processing components of the invention to be described may be implemented as respective gate array-configured application specific integrated circuits or ASICs. As a result, for the most part, the configurations of such devices, components and circuits, and the manner in which they are interfaced with other system equipment including antenna weight/phase shift elements for antenna elements of a phased array antenna system, have been illustrated in the drawings by readily understandable block diagrams, which show only those specific details that are pertinent to the present invention, so as not to obscure the disclosure with details which will be readily apparent to those skilled in the art having the benefit of the description herein. Thus, the block diagram illustrations are primarily intended to show the major components of a phased array antenna system in a convenient functional grouping and processing sequence, whereby the present invention may be more readily understood.

Referring now to FIG. 1, the front or head end of a serial pipelined signal processing architecture of the present invention is diagrammatically illustrated as comprising a head end control processor 10, which is coupled to receive digitally formatted antenna beam steering or pointing angle data (e.g., conventional multibit (Φ,Θ) data) from the host. Control processor 10 is operative to execute the requisite trigonometric calculations through which the (Φ,Θ) beam steering data is transformed into phase gradient data in the (X,Y) coordinate system of the phased array. As pointed out above, confining the trigonometric transform operations to a single processing unit at the source end of the pipeline considerably reduces the computational and hardware complexity of the system.

The serially formatted X and Y phase gradient data generated by the control processor 10 are asserted onto a serial communication (pipeline) link 14 for transport to a plurality of subarray control processors 20-1, . . . 20-N, that are sequentially distributed along the pipeline link 14. Each subarray controller 20-i is preferably implemented as a pipelined multiplier, such as that diagrammatically shown in FIG. 3 to be described, as a non-limiting example, and is operative to convert the serial (X,Y) phase gradient data it receives from the control processor 10 into a subset of multibit (serial or parallel) phase shift parameter data, that define contributions of a prescribed portion of the composite beam produced by a multi-element antenna array 30.

These sets of phase shift parameter data are applied over respective ones of multibit (serial or parallel) digital output links 22-1, . . . , 22-M to associated subsets of phase shift data generation ASICs 23-1, . . . , 23-M. The resultant phase shift data is then coupled to control the operation of respective phase shift (ΦS) elements 24-1, . . . , 24-M. The phase shift elements 24 are operative to adjust RF input signals coupled thereto and drive associated antenna elements 30-1, . . . , 30-M of a prescribed spatial subset of the multi-element antenna array 30.

Because of the physical separations among the various components of the system, in particular, the differential spacings among the plurality of subarray control processors 20-1, . . . 20-N, as sequentially distributed along the pipeline link 14, the point in time at which a respective subarray control processor 20-i receives and processes any given bit of the serial phase gradient data being supplied by the control processor 10 will necessarily differ from those of every other subarray control processor 20-j.

To compensate for these spacing and therefore time of receipt differentials, a prescribed serial throughput delay is incorporated into the signal processing flow path through each subarray control processor. This delay is defined such that the phase shift element control signals produced by each subarray control processor 20-i will be applied simultaneously to its associated subsets of antenna phase control elements 24, including any intermediate control elements such as the phase data ASICs 23 shown in FIG. 1. The phase data ASIC includes whatever additional logic circuitry is required for a particular application, such as, but not limited, to serial-to-parallel converison, calibration adjustments, etc.

A respective subarray controller 20-N completes its phase weight calculation "just in time" to receive the first bit of the next phase gradient data word from the control processor 10. No writing to and reading from (random access) memory as in the prior art is involved. This means that the processing throughput matches the data rate, so that the composite beam pattern can be updated at the phase gradient word rate of the serial pipeline.

Figure 2:
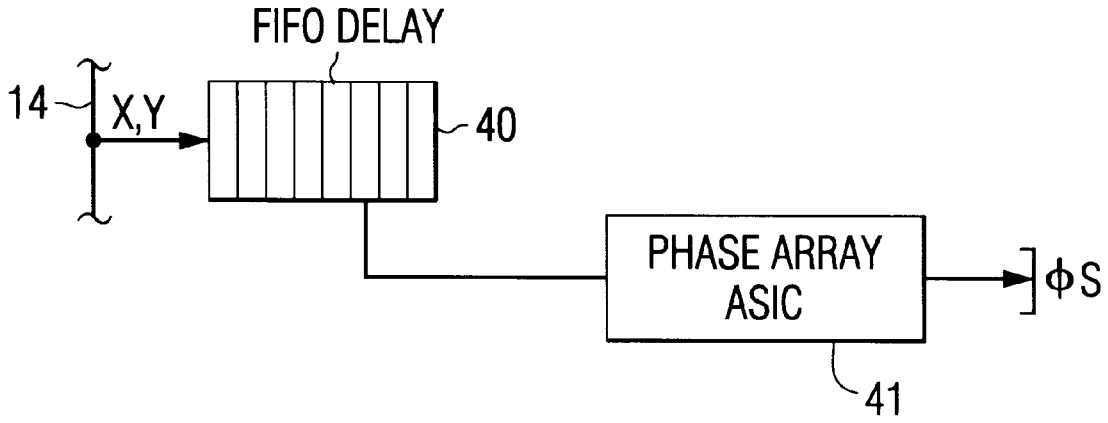
FIG. 2 diagrammatically illustrates a subarray controller of the pipelined signal processing architecture of FIG. 1.

For this purpose, as diagrammatically illustrated in FIG. 2, the serial data processing flow path through each subarray controller 20-i includes a serially shifted, first-in, first-out (FIFO) implemented path delay, which may be readily implemented as a tapped or selectable length shift register 40-i, which is clocked at the serial data rate. The tap stage 42-i of each shift register 40-i is selected such that each subarray controller 20-i outputs a respective calculated phase shift data bit for a given phase gradient input bit supplied from the control processor 10 just at the point (in time) that the last subarray controller processor 20-N down the pipeline 14 outputs its calculated phase shift data bit for that same phase gradient input bit supplied by the control processor 10. This means as each new data bit is processed by a subarray controller, that subarray controller can begin processing the next successive data bit propagating down the serial pipeline link 14. This not only ensures that all subarray controller outputs are applied simultaneously to their associated phase shift elements 24 for updating the beam pattern of the antenna array, but are optimized for the serial data rate of the phase gradient transport link 14, so that the data processing and transport bandwidth of the system is maximized.

In the diagrammatic illustration of FIG. 2, a FIFO delay 40 is shown as being installed between the link 14 and a phase weight calculation gate array ASIC 41, the outputs of which are coupled to a subset of phase shift elements 24, as a non-limiting example. As an alternative, non-limiting equivalent, the FIFO delay 40 may be installed at the output of the phase weight calculation gate array circuit 41, the input of which is coupled to the pipeline link 14. As noted earlier, the use of serial (FIFO) delays to equalize pipeline and processing latency allows each subarray controller to process and ship serial beam vector data at the data rate at which it is received from the control processor.

Namely, since only a serial delay is employed in the data processing transport path through each subarray controller, the beam pattern update rate is limited only by the serial processing speed through the subarray controllers 20. This allows the weights of all the phase control elements 24 of the phased array antenna to be updated simultaneously at a beam pattern update rate that corresponds to the word transmission rate of the pipeline 14. A respective subarray controller 20 converts the serial phase gradients to the required set of phase shift values. A preferred implementation of this function is as a pipelined engine, which employs a pipelined serial multiplier with separate outputs for each phase shifter.

Figure 3:
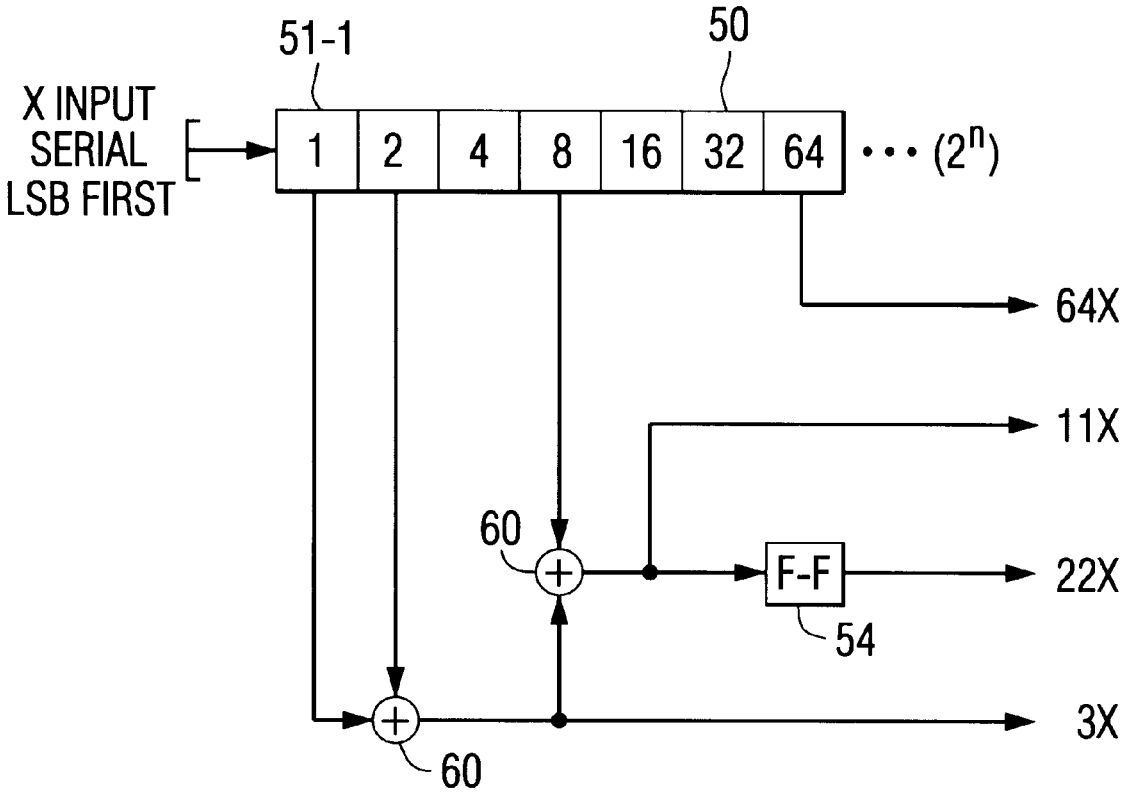
FIG. 3 diagrammatically illustrates a pipelined multiplier utilized in the phase data calculation of a respective subarray controller.

Such a preferred, but non-limiting example of a pipelined multiplier utilized in the data processing functionality for either the X or Y dimension of a respective subarray controller 20 is diagrammatically illustrated in FIG. 3. As shown therein, an n-bit shift register 50 delay line has a first stage 51-1 to which the serial data from the pipeline 14 is supplied—least significant bit first. Selected stages 51 of the shift register 50 are summed through an approriate set of adders 60 to produce the desired simultaneous multiplication outputs.

One or more (pipeline delay) flip-flops, one of which is shown at 54, may be coupled to a selected adder, to effectively provide a "times 2" multiplier. The multiplier of FIG. 3 is operative to perform a pipeline calculation of the value KX, where X is the serial digital word supplied to the shift register 50 and K is the required set of multiplicative constants. Where the antenna elements of the phased array antenna are spatially organized into orthogonal rows and columns, the multiplier of FIG. 3 can perform the requisite vector multiplication of the X (and Y) phase gradient input value times the normalized row (or column) positions of each element.

While we have shown and described an embodiment in accordance with the present invention, it is to be understood that the same is not limited thereto but is susceptible to numerous changes and modifications as are known to a person skilled in the art, and we therefore do not wish to be limited to the details shown and described herein, but intend to cover all such modifications and changes as are obvious to one of ordinary skill in the art.

What is claimed:

1. An apparatus for controlling the operation of a phased array antenna, said phased array antenna having an array of antenna elements and an associated set of phase control elements through which a composite beam pattern produced by said phased array antenna is established, said apparatus comprising:

a control processing unit, coupled to receive information signals representative of intended characteristics of said composite beam pattern and being operative to output serial data representative of information for setting phase parameters of said phase control elements and thereby cause said array of antenna elements to produce said composite beam pattern; and a plurality of subarray control processor units coupled in series along a serial communication link to which said serial data output by said control processing unit is supplied, a respective subarray control processor unit being operative to process serial data received thereby and to produce therefrom phase control signals that are applied to an associated subset of selected ones of said phase control elements and thereby define the contribution to said composite beam pattern of a subarray of antenna elements driven thereby; and wherein signal propagation paths from said serial communication link through said subarray control processors to respective associated subsets of selected phase control elements have respectively different delays such that output phase control signals produced by said subarray control processors are applied simultaneously to said associated subsets of phase control elements.

2. An apparatus according to claim 1, wherein said control processing unit is coupled to receive information signals representative of intended characteristics of a plurality of respectively different composite beam patterns to be sequentially produced by said phased array antenna at a prescribed beam pattern update rate, and is operative to output, at a data rate sufficient to achieve said prescribed beam pattern update rate, serial data for setting phase parameters of said phase control elements for varying said composite beam pattern so as to sequentially produce respectively different composite beam patterns at said prescribed update rate, and wherein each subarray control processor unit is operative to process said serial data as supplied thereto by said serial communication link at said data rate, and to output successive phase control signals that are applied at said prescribed update rate to said associated subset of selected ones of said phase control elements, whereby the contribution to said composite beam pattern of each subarray of antenna elements driven thereby is simultaneously updated at said prescribed update rate.

3. An apparatus according to claim 1, wherein said control processing unit is coupled to receive information signals representative of successive pointing directions of said composite beam pattern, and is operative to output serial data representative of phase gradient information for setting phase parameters of said phase control elements that cause said array of antenna elements to produce a composite beam pattern that is sequentially directed in said successive pointing directions at said prescribed update rate.

4. An apparatus according to claim 1, wherein said signal propagation paths include first-in, first-out (FIFO) units having said respectively different delays.

5. An apparatus according to claim 1, wherein said each subarray control processor unit is operative to process said serial data as supplied thereto by said serial communication link at said data rate, and to couple successive phase control signals produced thereby, at said prescribed update rate through a first-in, first-out (FIFO) unit to an associated subset of selected ones of said phase control elements, said FIFO having a delay such that said successive phase control signals produced by said each subarray control processor unit are applied to said associated subset of phase control elements simultaneously with the application of successive phase control signals produced by every other subarray control processor unit to their associated subsets of phase control elements.

6. A method of controlling the operation of a phased array antenna having an array of antenna elements and an associated set of phase control elements through which a composite beam pattern produced by said phased array antenna is established, comprising the steps of:

(a) processing information signals representative of intended characteristics of said composite beam pattern and producing serial output data representative of information for setting phase parameters of said phase control elements that cause said array of antenna elements to produce said composite beam pattern; and (b) successively processing said serial output data in a plurality of subarray control processor units to produce phase control signals that are coupled to respectively different subsets of said phase control elements to define the contribution to said composite beam pattern of associated subarrays of antenna elements driven thereby; and wherein signal propagation paths through said subarray control processors to respective associated subsets of selected phase control elements have respectively different delays such that said phase control signals produced by said plurality of subarray control processors are applied simultaneously to said subsets of phase control elements.

7. A method apparatus according to claim 6, wherein step (a) comprises (a1) receiving information signals representative of intended characteristics of a plurality of respectively different composite beam patterns to be sequentially produced by said phased array antenna at a prescribed beam pattern update rate, and (a2) generating, at a data rate sufficient to achieve said prescribed beam pattern update rate, serial data for setting phase parameters of said phase control elements for varying said composite beam pattern so as to sequentially produce respectively different composite beam patterns at said prescribed update rate, and wherein step (b) comprises processing, in each subarray control processor unit, said serial data as supplied thereto at said data rate, so as to generate successive phase control signals that are applied at said prescribed update rate to said associated subset of selected ones of said phase control elements, whereby the contribution to said composite beam pattern of each subarray of antenna elements driven thereby is simultaneously updated at said prescribed update rate.

8. A method according to claim 6, wherein said information signals are representative of successive pointing directions of said composite beam pattern, and wherein step (a) comprises generating serial data representative of phase gradient information for setting phase parameters of said phase control elements that cause said array of antenna elements to produce a composite beam pattern that is sequentially directed in said successive pointing directions at said prescribed update rate.

9. A method apparatus according to claim 6, wherein said signal propagation paths include first-in, first-out (FIFO) units having said respectively different delays.

10. A method according to claim 6, wherein, in step (b), said each subarray control processor unit is operative to process said serial data supplied at said data rate, and to couple successive phase control signals produced thereby, at said prescribed update rate through a first-in, first-out (FIFO) unit to an associated subset of selected ones of said phase control elements, said FIFO having a delay such that said successive phase control signals produced by said each subarray control processor unit are applied to said associated subset of phase control elements simultaneously with the application of successive phase control signals produced by every other subarray control processor unit to their associated subsets of phase control elements.

* * * * *